US008845218B2

(12) United States Patent
Hoffman et al.

(10) Patent No.: US 8,845,218 B2
(45) Date of Patent: Sep. 30, 2014

(54) CREDENTIAL PRODUCTION DEVICE HAVING A UNITARY FRAME

(75) Inventors: Ted M. Hoffman, Eden Prairie, MN (US); James R. Cedar, Plymouth, MN (US)

(73) Assignee: Assa Abloy AB, Stockholm (SE)

( * ) Notice: Subject to any disclaimer, the term of this patent is extended or adjusted under 35 U.S.C. 154(b) by 2001 days.

(21) Appl. No.: 11/683,710

(22) Filed: Mar. 8, 2007

(65) Prior Publication Data

US 2008/0216693 A1 Sep. 11, 2008

(51) Int. Cl.
*B41J 29/02* (2006.01)

(52) U.S. Cl.
CPC ..... *B41J 29/02* (2013.01)
USPC ..... 400/692; 400/208; 400/693

(58) Field of Classification Search
USPC ..... 400/207
See application file for complete search history.

(56) References Cited

U.S. PATENT DOCUMENTS

| | | | |
|---|---|---|---|
| 2,401,719 | A | 6/1946 | Braun |
| 3,731,781 | A | 5/1973 | Caudill et al. |
| 3,948,506 | A | 4/1976 | Crimmins et al. |
| 3,961,785 | A | 6/1976 | Gall |
| 4,299,504 | A | 11/1981 | Benz et al. |
| 4,305,577 | A | 12/1981 | Clay et al. |
| 4,527,149 | A | 7/1985 | Swensen |
| 4,590,486 | A | 5/1986 | Yana ..... 346/76 PH |
| 4,592,634 | A | 6/1986 | Koch |
| 4,607,832 | A | 8/1986 | Abe |
| 4,609,298 | A | 9/1986 | Shioda |
| 4,615,628 | A | 10/1986 | Swinburne |

(Continued)

FOREIGN PATENT DOCUMENTS

| | | | |
|---|---|---|---|
| JP | 07040615 | A | 2/1995 |
| JP | 07256755 | A | 10/1995 |
| JP | 10016186 | A | 1/1998 |
| WO | WO 2005/096724 | | 3/2005 |

OTHER PUBLICATIONS

International Search Report and Written Opinion of PCT/US2008/002207 filed on Feb. 20, 2008.

(Continued)

*Primary Examiner* — Jill Culler
(74) *Attorney, Agent, or Firm* — Brian D. Kaul; Westman, Champlin & Koehler, P.A.

(57) ABSTRACT

A credential production device includes a unitary frame formed of plastic, a first processing component and a second processing component. The unitary frame includes a rear wall, a pair of side walls extending from opposing sides of the rear wall, a top wall extending from a top side of the rear wall and coupled to the side walls, a bottom wall extending from a bottom side of the rear wall and coupled to the side walls, a first device registration member and a second device registration member. The rear wall, the side walls, the top wall and the bottom wall define an interior cavity and an opening to the interior cavity. The first processing component includes a first frame registration member that is configured to cooperate with the first device registration member to place the first processing component in a known position relative to the unitary frame and the second device registration member. The second processing component includes a second frame registration member configured to cooperate with the second device registration member to place the second processing component in a known position relative to the unitary frame, the first device registration member and the first processing component.

20 Claims, 13 Drawing Sheets

(56) References Cited

U.S. PATENT DOCUMENTS

| | | | | |
|---|---|---|---|---|
| 4,685,815 | A | 8/1987 | Baranyi | |
| 4,869,455 | A * | 9/1989 | Weeks | 400/691 |
| 4,938,616 | A | 7/1990 | Shiozaki et al. | |
| 4,990,008 | A | 2/1991 | Hwang | |
| 5,004,218 | A | 4/1991 | Sardano et al. | |
| 5,037,216 | A | 8/1991 | Nubson et al. | |
| 5,064,301 | A | 11/1991 | Nakamura et al. | |
| 5,220,355 | A | 6/1993 | Miyawaki | |
| 5,301,834 | A | 4/1994 | Lee et al. | |
| 5,366,306 | A * | 11/1994 | Mizutani et al. | 400/694 |
| 5,519,429 | A | 5/1996 | Zwijsen et al. | |
| 5,546,115 | A | 8/1996 | Nardone et al. | |
| 5,547,298 | A | 8/1996 | Wouters et al. | |
| 5,558,449 | A | 9/1996 | Morgavi | 400/188 |
| 5,597,248 | A | 1/1997 | Burgin | |
| 5,739,835 | A | 4/1998 | Morgavi et al. | 347/176 |
| 5,769,548 | A | 6/1998 | Thompson et al. | |
| 5,829,631 | A | 11/1998 | Kasper | |
| 5,895,157 | A | 4/1999 | Morimura et al. | |
| 5,936,646 | A | 8/1999 | Kenny et al. | |
| 5,941,522 | A | 8/1999 | Hagstrom et al. | |
| 6,261,012 | B1 * | 7/2001 | Haas et al. | 400/208 |
| 6,390,697 | B1 | 5/2002 | O'Mera et al. | |
| 6,486,904 | B1 | 11/2002 | Onozato et al. | |
| 6,604,876 | B2 | 8/2003 | Bryant et al. | 400/208 |
| 6,616,360 | B2 | 9/2003 | Lehmkuhl | 400/621 |
| 6,626,594 | B1 | 9/2003 | Lallemant | |
| 6,682,241 | B2 * | 1/2004 | Coons et al. | 400/692 |
| 6,714,228 | B1 | 3/2004 | Holland et al. | 347/214 |
| 6,827,509 | B2 | 12/2004 | Suden et al. | |
| 6,910,656 | B2 | 6/2005 | Lysiak et al. | 242/598.3 |
| 7,018,117 | B2 | 3/2006 | Meier et al. | 400/208 |
| 7,549,633 | B2 | 6/2009 | Nishitani et al. | |
| 7,665,920 | B2 | 2/2010 | Hoffman et al. | |
| 2001/0046401 | A1 | 11/2001 | Lien et al. | |
| 2003/0025781 | A1 | 2/2003 | Honma et al. | |
| 2004/0109715 | A1 | 6/2004 | Meier et al. | 400/191 |
| 2005/0078998 | A1 | 4/2005 | Lien et al. | 400/703 |
| 2005/0095049 | A1 * | 5/2005 | Yoshida et al. | 400/223 |
| 2008/0216686 | A1 | 9/2008 | Hoffman et al. | |
| 2008/0216688 | A1 | 9/2008 | Hoffman et al. | |
| 2008/0217842 | A1 | 9/2008 | Hoffman et al. | |
| 2008/0219735 | A1 | 9/2008 | Hoffman | |
| 2008/0219739 | A1 | 9/2008 | Hoffman | |

OTHER PUBLICATIONS

International Search Report and Written Opinion of PCT/US2008//001031 filed on Jan. 25, 2008.

International Search Report and Written Opinion of PCT/US2008/000853 filed on Jan. 23, 2008.

International Search Report and Written Opinion of PCT/US2008/000851 filed on Jan. 23, 2008.

* cited by examiner

FIG. 10
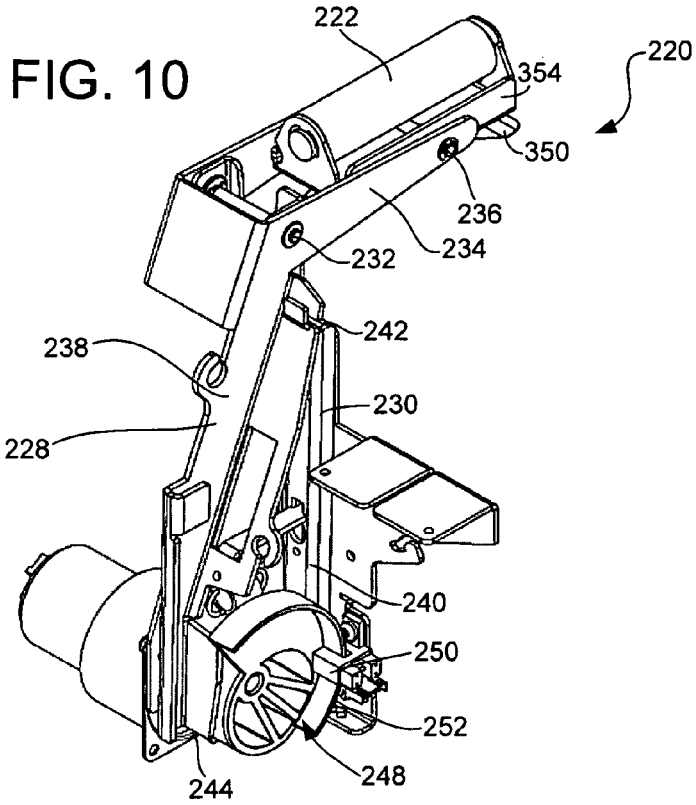
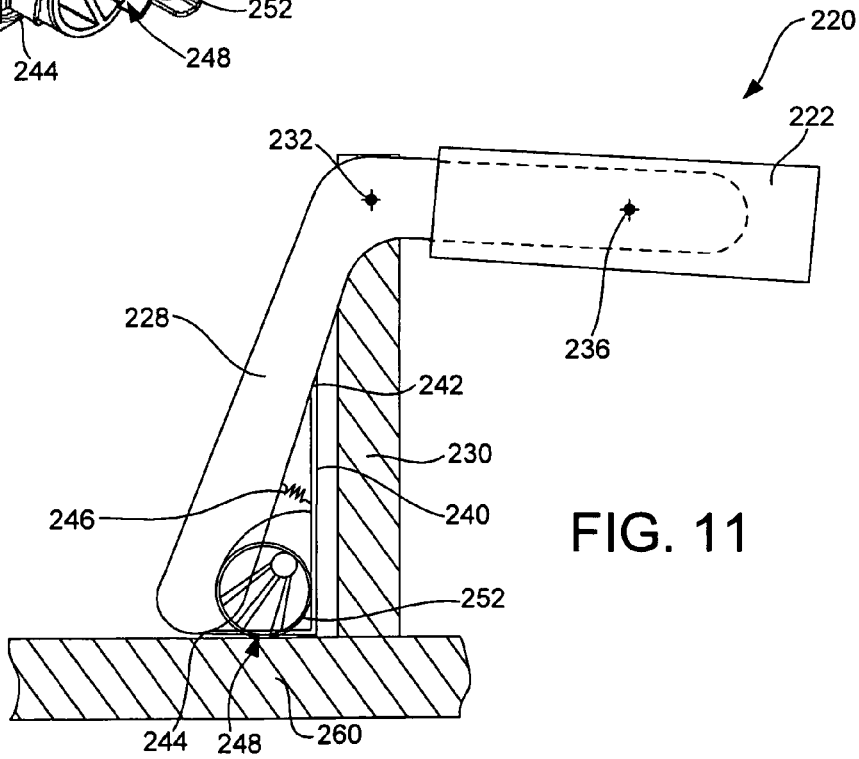
FIG. 11

CREDENTIAL PRODUCTION DEVICE HAVING A UNITARY FRAME

CROSS-REFERENCE TO RELATED APPLICATIONS

This application incorporates herein by reference in their entirety the following applications filed Mar. 8, 2007: U.S. patent application Ser. No. 11/683,771 entitled "Substrate Feeding in a Credential Production Device"; U.S. patent application Ser. No. 11/683,795 entitled "Card Holder for a Credential Production Device"; U.S. patent application Ser. No. 11/683,816 entitled "Credential Production Print Ribbon and Transfer Ribbon Cartridges"; U.S. patent application Ser. No. 11/683,827 entitled "Printhead Assembly for a Credential Production Device"; U.S. patent application Ser. No. 11/683,835 entitled "Cantilevered Credential Processing Device Component"; and U.S. patent application Ser. No. 11/683,850 entitled "Inverted Reverse-Image Transfer Printing".

FIELD OF THE INVENTION

The present invention is generally directed to a credential production device. More particularly, the present invention is directed to a credential production device that includes a unitary frame.

BACKGROUND OF THE INVENTION

Credential production devices process credential substrates to form credentials, such as, for example, identification cards, driver's licenses, passports, and other valuable documents. The credential substrates that are used to form such credentials include, for example, paper substrates, plastic substrates, semi-rigid or rigid plastic cards, and other materials. Exemplary processes performed on the credential substrates by credential production devices to produce the credential include printing an image on the substrate, writing data to the substrate, applying an overlaminate material to the substrate and other processes.

Traditionally, credential production devices utilize a frame comprising several parts that are coupled together using screws, rivets, or other fastening method. The processing devices of the production device, such as the printhead, print platen, ribbon cartridges (e.g., print ribbon cartridge, transfer ribbon cartridge, etc.) and other processing devices, are connected to the frame.

The quality of the processes performed on the credential substrates by the processing devices of the credential production device, are related to the preciseness to which the various components are positioned relative to each other. For example, misalignment of a printhead to the print platen can result in a deviation of the printing process (e.g., a pressure applied to the print platen) that adversely affects the quality of the image that is printed to the substrate. For conventional production devices, the preciseness to which the various components are positioned relative to each other is dependent on the build-up of tolerances between the components including those of the components that form the sheet metal frame. Unfortunately, the multiplicity of components forming the frame that are interconnected between processing devices of the credential production device places a limit on the preciseness to which the components can be located relative to one another and, therefore, the quality of the processes that are performed on the credential substrates.

There is a continuous demand for low-cost credential production devices that are capable of producing high quality credentials.

Embodiments of the present invention provide solutions to these and other problems, and offer other advantages over the prior art.

SUMMARY OF THE INVENTION

Embodiments of the present invention are directed to a credential manufacturing device that includes a unitary frame formed of plastic, a first processing component and a second processing component. The unitary frame includes a rear wall, a pair of side walls extending from opposing sides of the rear wall, a top wall extending from a top side of the rear wall and coupled to the side walls, a bottom wall extending from a bottom side of the rear wall and coupled to the side walls, a first device registration member and a second device registration member. The rear wall, the side walls, the top wall and the bottom wall define an interior cavity and an opening to the interior cavity. The first processing component includes a first frame registration member that is configured to cooperate with the first device registration member to place the first processing component in a known position relative to the unitary frame and the second device registration member. The second processing component includes a second frame registration member configured to cooperate with the second device registration member to place the second processing component in a known position relative to the unitary frame, the first device registration member and the first processing component.

BRIEF DESCRIPTION OF THE DRAWINGS

FIG. 10 is an oblique view of a transfer roller assembly in accordance with embodiments of the invention.

FIG. 11 is a schematic diagram of a transfer roller assembly in accordance with embodiment of the invention.

DETAILED DESCRIPTION OF ILLUSTRATIVE EMBODIMENTS

Although the present invention has been described with reference to preferred embodiments, workers skilled in the art will recognize that changes may be made in form and detail without departing from the spirit and scope of the invention.

Figure 1:
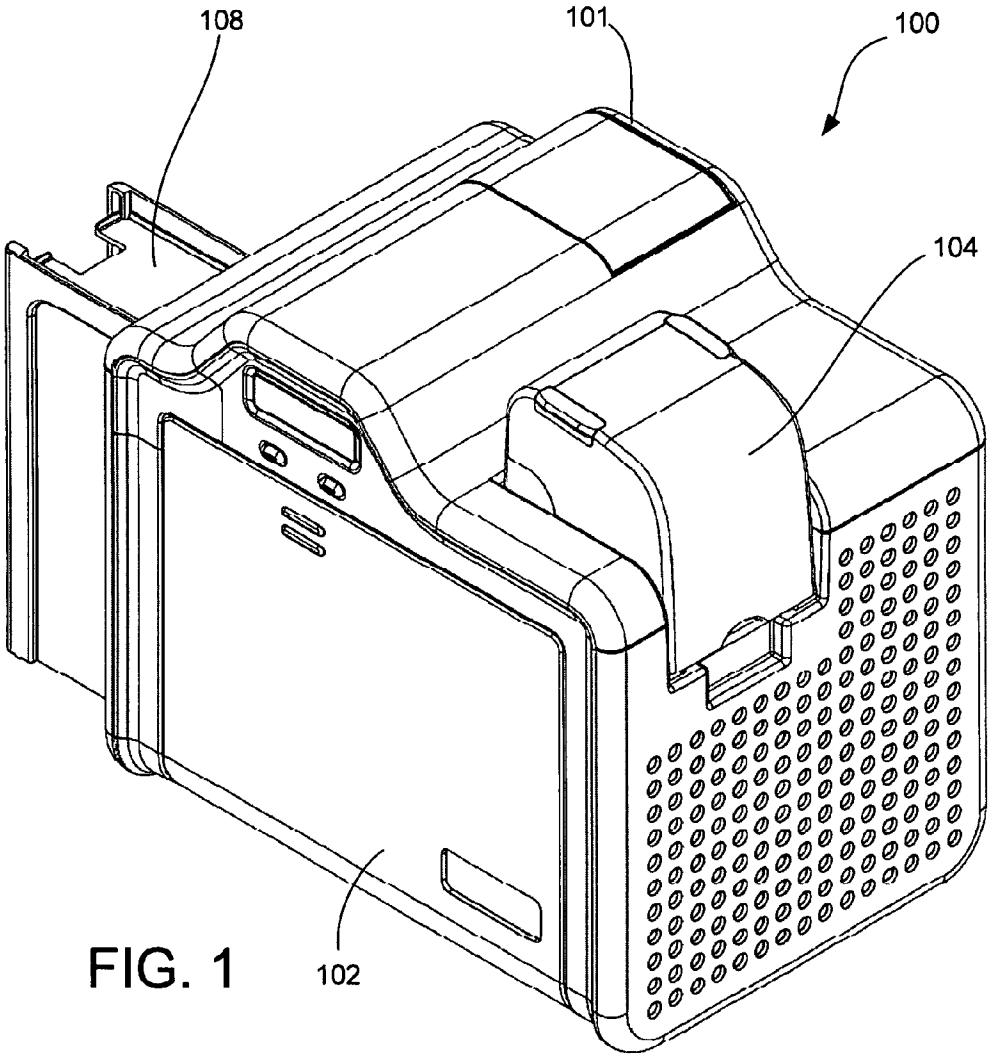
FIG. 1 is an oblique view of an exemplary credential production device in accordance with embodiments of the invention.
Figure 2:
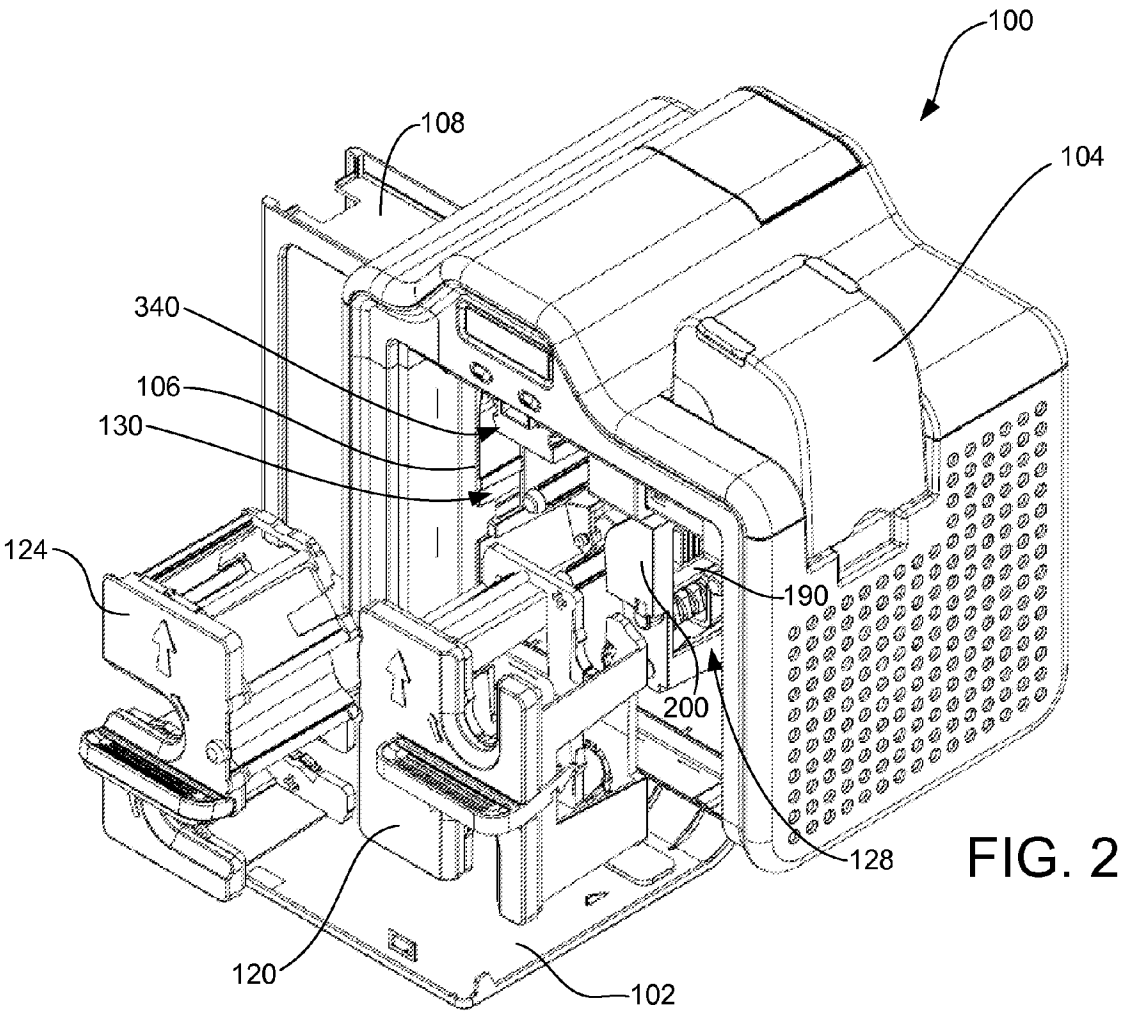
FIG. 2 is an oblique view of the credential production device of FIG. 1 with a front cover opened and print and transfer ribbon cartridges removed.
Figure 3:
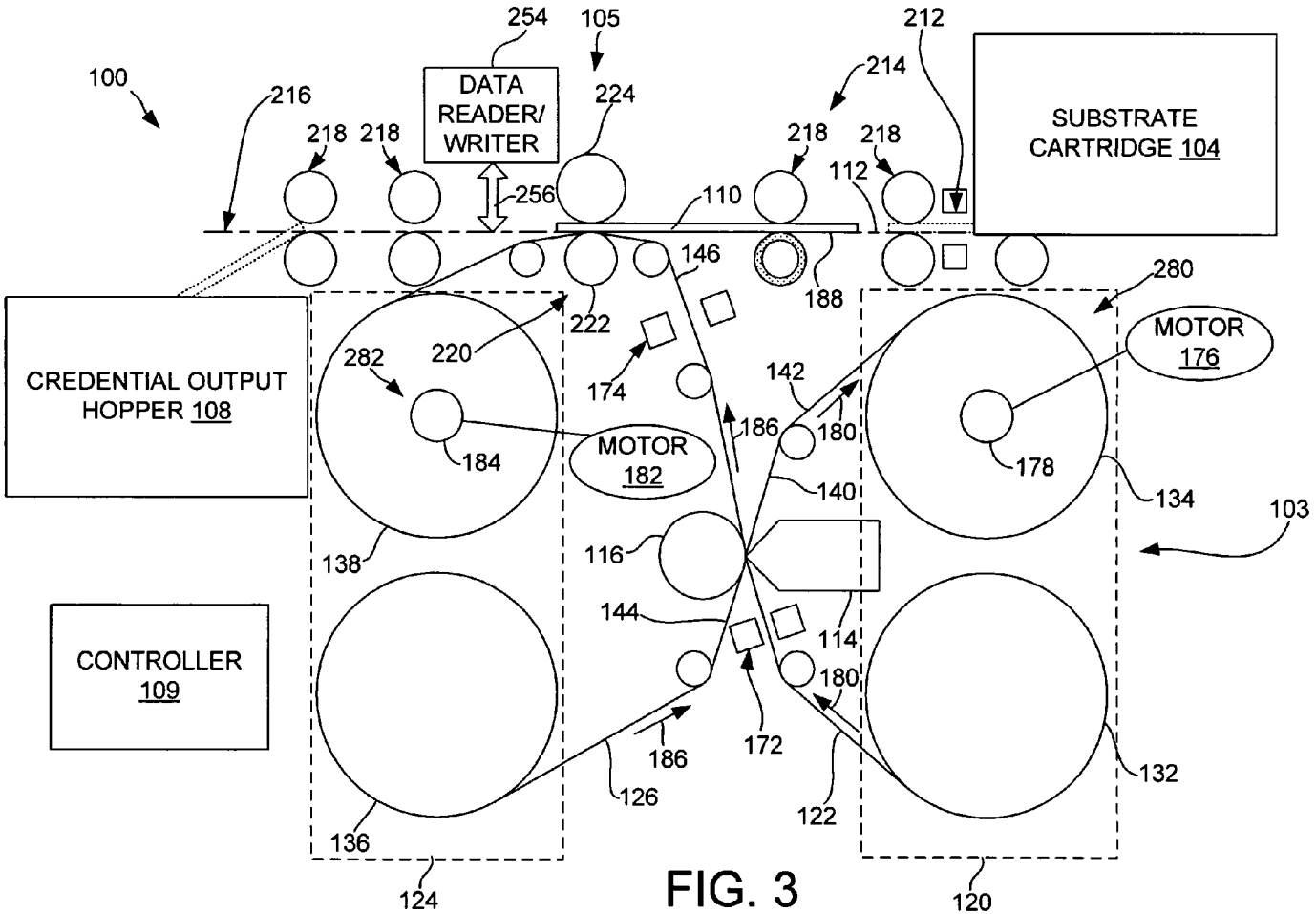
FIG. 3 is a schematic diagram of a credential production device in accordance with embodiments of the invention.

Embodiments of the disclosure pertain to a credential production device that is used in the production of a credential such as an identification card or a passport, for example. FIGS. 1-3 illustrate an exemplary credential production device 100 in accordance with embodiments of the invention. While the exemplary credential production device 100 is in the form of a reverse-image identification card printer, it is understood that embodiments of the present invention described below are applicable to other types of credential production devices or components thereof such as, for example, printers that print directly to a credential substrate using thermal (i.e., dye sublimation) or ink jet printing methods, credential laminating devices that laminate one or more surfaces of a credential substrate, credential data readers and/or writers that read and/or write data to a magnetic stripe or a memory (e.g., smartcard) of a credential substrate, and other credential production related devices.

Embodiments of the credential production device 100 include an enclosure or housing 101 having a front panel 102, a printing section 103, a substrate supply or cartridge 104, an image transfer section 105, a unitary frame 106, and/or a credential output hopper 108, as shown in FIGS. 1-3. A controller 109 generally controls the components of the credential production device 100 to perform various operations including printing, imaging transfer, sensor calibration and other operations. FIGS. 1 and 2 are oblique views of the device 100 and FIG. 3 is a schematic diagram of the device 100. In FIG. 2, the front panel 102 is opened and some of the removable components are exploded.

The printing section 103 and the image transfer section 105 operate to print an image to a bottom surface of a credential substrate 110. These printing components are "inverted" relative to those in a conventional reverse-image printing device, with respect to a processing path 112, shown in FIG. 3, along which the credential substrate 110 travels. The "inverted" printing and image transfer sections 103 and 105 are positioned below the processing path 112 rather than above the processing path 112 as in conventional printers.

This inverted configuration allows the credential production device 100 to be formed more compactly in height than conventional "non-inverted" printing devices. For instance, conventional credential printing devices place their printing components above their processing paths and print an image to a top surface of the substrate. Such conventional credential printing devices also include an output hopper that is configured to collect discharged substrates. The height of these conventional devices is dictated by the space required to accommodate the printing components above the processing path and the space required to accommodate the collection of discharged substrates in the output hopper.

Unlike these conventional "non-inverted" printing devices, the present invention eliminates the need to accommodate the printing components above the processing path. As a result, the height of the credential production device 100 of the present invention, is generally determinedly the larger of the space required to accommodate the printing components and the space required to accommodate the output hopper 108. Since the height of the output hopper 108 can be adjusted based on the printing and image transfer components, it is the space requirement of the printing components that will generally determine the height of the credential production device 100. Therefore, the height of the "inverted" credential production device 100 can be formed much less than that of conventional "non-inverted" printing devices.

In one embodiment, the printing section 103 includes a printhead 114, a print platen 116, a print ribbon cartridge 120 for supporting a print ribbon 122 and a transfer ribbon cartridge 124 for supporting a transfer ribbon 126. The unitary frame 106 includes a print ribbon cartridge receiver 128 that receives the print ribbon cartridge 120 and a transfer ribbon cartridge receiver 130 that receives the transfer ribbon cartridge 124, as shown in FIG. 2.

Figure 4:
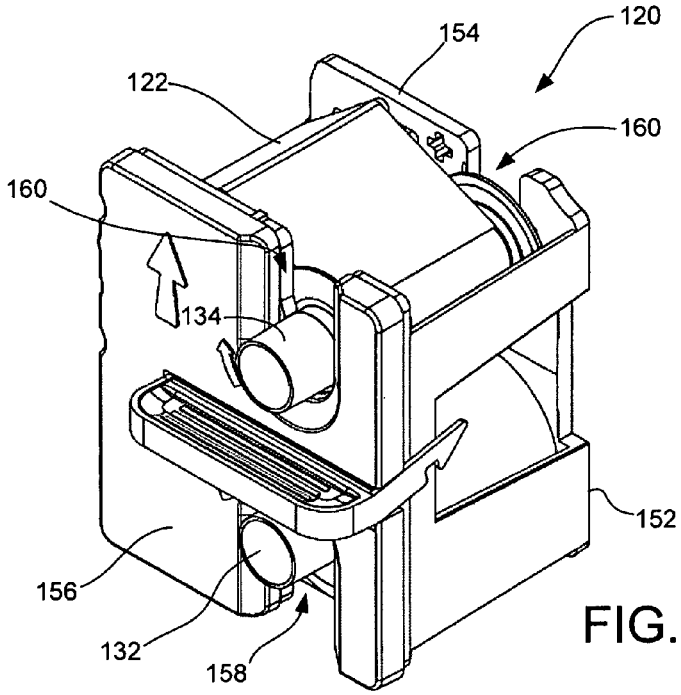
FIGS. 4 and 5 respectably are front oblique views of a print ribbon cartridge and a transfer ribbon cartridge in accordance with embodiments of the invention.
Figure 5:
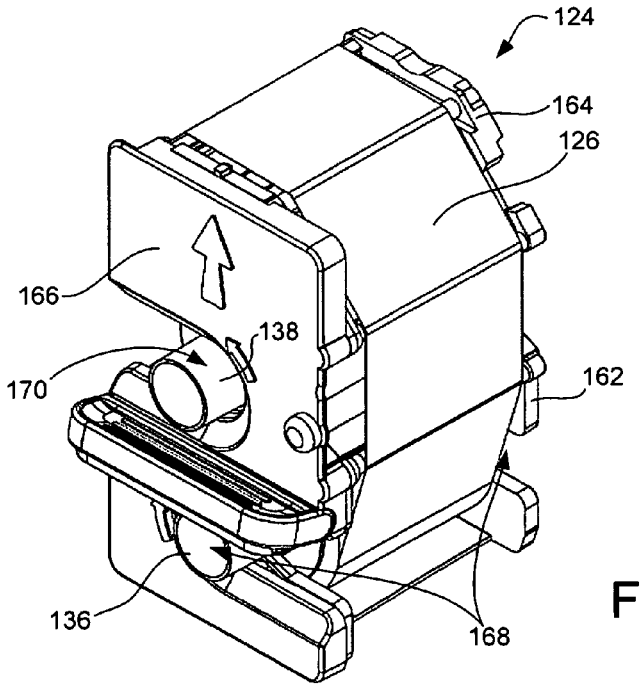
Figure 6:
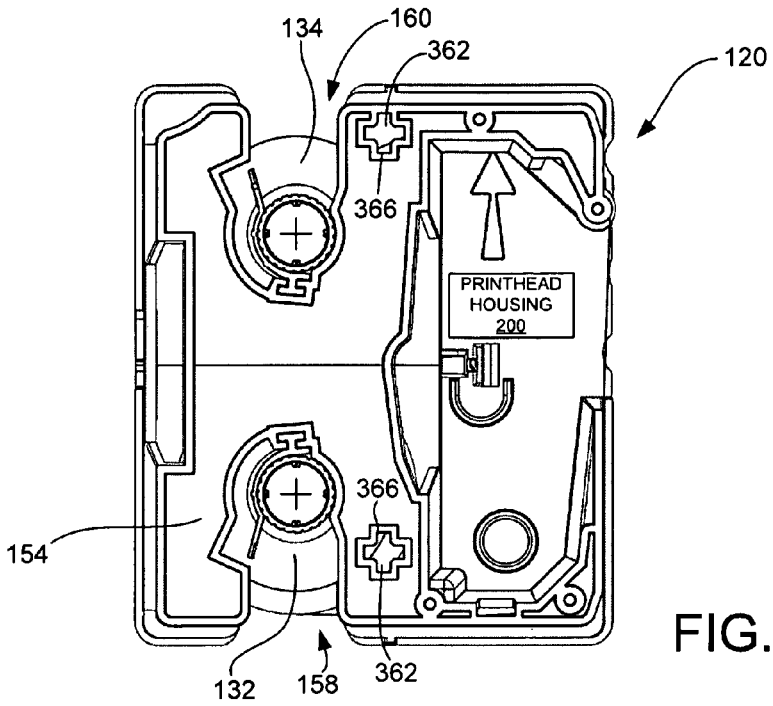
FIGS. 6 and 7 respectably are rear plan views of a print ribbon cartridge and a transfer ribbon cartridge in accordance with embodiments of the invention.
Figure 7:
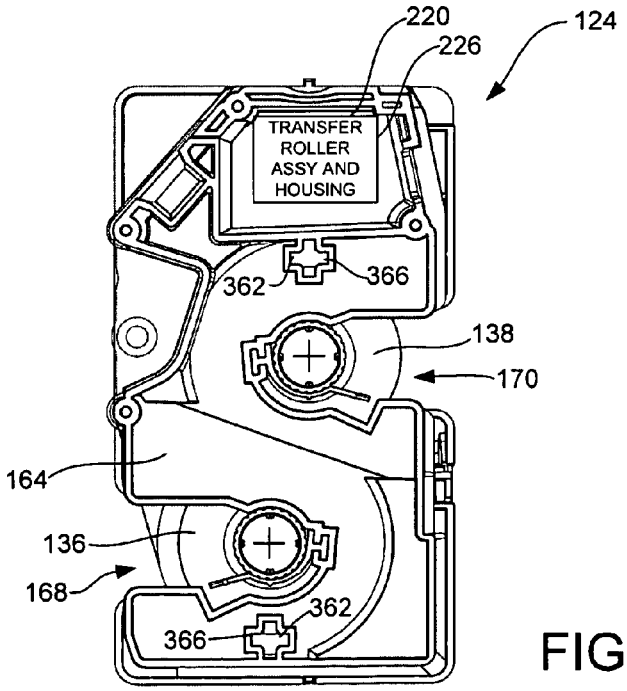

FIGS. 4 and 5 respectively are front oblique views of exemplary print and transfer ribbon cartridges 120 and 124 and FIGS. 6 and 7 respectively are rear plan views of the print and transfer ribbon cartridges 120 and 124, in accordance with embodiments of the invention. As illustrated in FIG. 2, cartridges 120 and 124 are releasable and removable from credential production device 100 for loading and unloading print ribbon 122 and transfer ribbon 126. Print ribbon 122 (e.g., dye sublimation print ribbon) is wound about a supply spool 132 and a take-up spool 134. Transfer ribbon 126 is wound about a supply spool 136 and a take-up spool 138. The print ribbon 122 includes a first side 140 and a second side 142 opposite the first side. When the print ribbon 122 is wound about spools 132 and 134, the first side 140 faces the interior of print ribbon cartridge 120 and the second side 142 faces transfer ribbon cartridge 124. Transfer ribbon 126 includes a first side 144 and a second side 146 opposite the first side 144. When the transfer ribbon 126 is wound about the spools 136 and 138, the first side 144 faces the interior of the transfer ribbon cartridge 124 and the second side 146 faces the print ribbon cartridge 120.

The print ribbon cartridge 120 includes a housing 152 having a rear wall support 154 and a front wall support 156. The rear wall support 154 and the front wall support 156 cooperate to form a supply spool receiver 158 and a take-up spool receiver 160. The supply spool 132 is positioned in the supply spool receiver 158 (FIG. 4) and the take-up spool 134 is positioned in the take-up spool receiver 160 (FIG. 4).

The transfer ribbon cartridge 124 includes a housing 162 having a rear wall support 164 and a front wall support 166. The rear wall support 164 and the front wall support 166 cooperate to form a supply spool receiver 168 and a take-up spool receiver 170. The supply spool 136 is positioned in the supply spool receiver 168 (FIG. 5) and the take-up spool 138 is positioned in the take-up spool receiver 170 (FIG. 5).

In one embodiment, the credential production device 100 includes a print ribbon sensor 172 and a transfer ribbon sensor 174. In one embodiment, the print and transfer ribbon sensors 172 and 174 each include an emitter and a receiver and operate in accordance with conventional methods. The print ribbon sensor 172 provides an output signal to the controller 109 that is used to detect different color frames or panels of the print ribbon 122, such as yellow, magenta and cyan panels. The controller 109 uses signals derived from the sensed frames or panels to control a motor 176, which drives rotation of a shaft 178 that is coupled to the take-up spool 134 of the print ribbon cartridge 120 to feed the print ribbon 122 in a direction indicated by arrows 180.

The transfer ribbon sensor 174 is configured to produce an output signal in response to sensed transition marks on the transfer ribbon 126 that separate substantially clear or transparent panels along the length of transfer ribbon 126. The controller 109 uses the output signal from the sensor 174 to control the feeding of the transfer ribbon 126 using motor 182. Motor 182 drives a shaft 184 that is coupled to the take-up spool 138 of the transfer ribbon cartridge 124 to feed the transfer ribbon 126 in a direction indicated by arrows 186.

While the motors 176 and 184 are operating, the printhead 114 applies pressure against the print platen 116 such that printhead 114 is in contact with the first side 140 of the print ribbon 122 and brings the print ribbon 122 in contact with the second side 146 of the transfer ribbon 126. In one embodiment, the printhead 114 is a thermal printhead having burn elements. The burn elements of the printhead 114 are energized to generate heat which causes dye in the print ribbon 122 to transfer onto a panel of transfer ribbon 126. The image generated using this dye transfer process is generally a "reverse image" of that ultimately intended to be viewed on the surface 188 of the substrate 110. The printhead 114 prints to the panels of the transfer ribbon 126 while oriented transversely to the credential substrate path 112. In one embodiment, the tangent to the platen where pressed by the printhead 114 is approximately perpendicular to the processing path 112.

Figure 8:
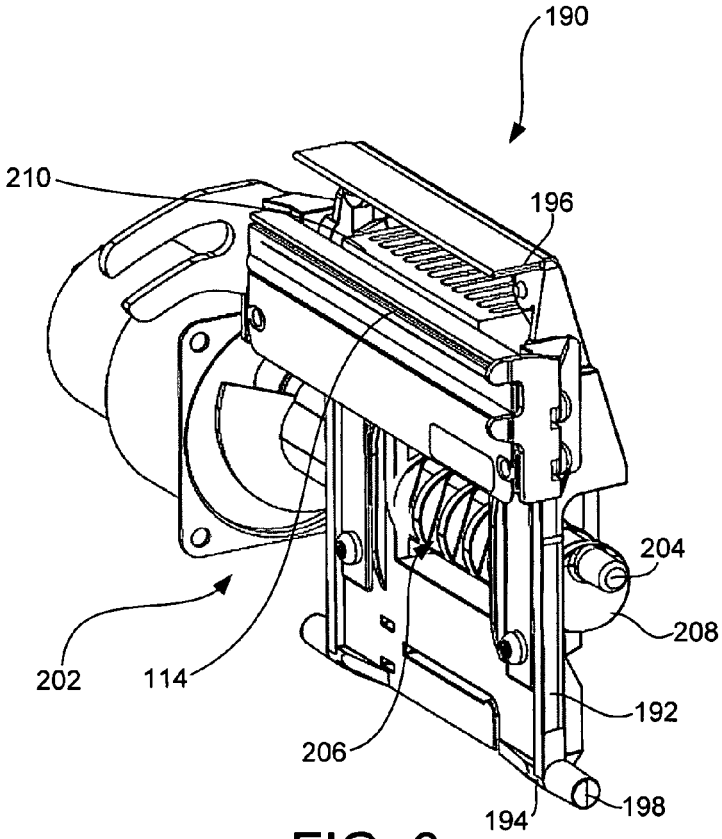
FIG. 8 is an oblique view of a print head assembly in accordance with embodiments of the invention.

One embodiment of the printhead 114 is in the form of a printhead assembly 190, shown in FIG. 8. Embodiments of the printhead assembly 190 include a support member 192 having a first end 194 and a second end 196. The printhead assembly 190 includes a pivotable coupling 198 that is partially supported by a printhead housing 200 (FIG. 2) of the unitary frame 106 at the first end 194. The print cartridge 120 receives the printhead housing 200 and the printhead 114, as illustrated in FIG. 6. The pivotable coupling 198 allows the support member 192 to be rotated relative to the printhead housing 200. The printhead 114 is attached to the second end 196 of the support member 192. The printhead assembly 190 includes an actuation mechanism 202 coupled to the support member 192. The actuation mechanism 202 is configured to pivot the support member 192 relative to the printhead housing 200 to move the printhead 114 between an idle position, in which the printhead 114 is moved away from the platen 116, to a print position in which the printhead 114 presses the print ribbon 122 and the transfer ribbon 126 against the platen 116.

The actuation mechanism 202 is pivotably coupled to the support member 192 at a pivot point 204, which is supported by the printhead housing 200 and generally held in a fixed location relative to the printhead housing 200. In one embodiment, the actuation mechanism includes a cam mechanism 206 having a cam element 208 that rotates about the pivot point 204 along a cam path 192. As the cam mechanism 206 rotates, the cam element 208 engages the support member and directs the printhead 114 either toward or away from platen 116.

In one embodiment, the printhead assembly 190 also includes a heat sink 210, which is coupled to the printhead 114. The heat sink 210 is configured to dissipate heat generated by the burn elements of the printhead 114. The heat sink 210 efficiently uses airflow through the device 100 to cool the printhead 114.

After the printing section 103 prints the reverse-image to the transfer film 126, the reverse image on the panel of transfer ribbon 126 is then moved towards the credential substrate path 112 for transferring the reverse image to the bottom surface 188 of the credential substrate 110 using the image transfer section 105. Embodiments of the image transfer section 105 include combinations of a substrate input 212, a substrate transport 214, a substrate output 216 and/or other components. In one embodiment, the credential substrates 110 are received by the substrate transport 214 from the substrate cartridge 104 at the substrate input 212. The substrate transport 214 feeds individual credential substrates 110 along the processing path 112. In one embodiment, the processing path 112 is substantially flat between the substrate input 212 and the substrate output 216 to avoid any bending or damaging of the substrates 110, particularly when they are in the form of rigid or semi-rigid plastic identification card substrates used to form identification cards.

Embodiments of the substrate transport 214 include substrate feed rollers 218, some of which are driven by one or more motors (not shown). It should be noted that in some embodiments separate motors can be used for different stages of substrate transport 214 through the credential production device 100. For example, a motor can be used to drive the feeding of the substrate 110 through substrate input 212 and another motor can be used to drive the feeding of the substrate 110 through the remaining substrate path 112 in the credential production device 100.

When the transfer ribbon cartridge 124 is inserted into the transfer ribbon cartridge receiver 130 of the credential production device 100, embodiments of the transfer ribbon cartridge 124 also engagingly receive a transfer roller assembly 220 (FIG. 7) that includes a transfer roller 222 (FIG. 3) of the image transfer section 105. The housing 162 of the transfer ribbon cartridge 124 accommodates movement of the assembly 220 toward and away from a platen 224. During image transfer, the transfer roller 222 is in contact with the first side 144 of the transfer ribbon 126 and presses the transfer ribbon 126 and the substrate 110 against the platen 224. The transfer roller 222 generates heat, which is applied to the reverse-image on the transfer film 126. This application of pressure and heat causes the reverse-image printed on the transfer ribbon 126 to transfer to the bottom surface 188 of the substrate 110.

Figure 9:
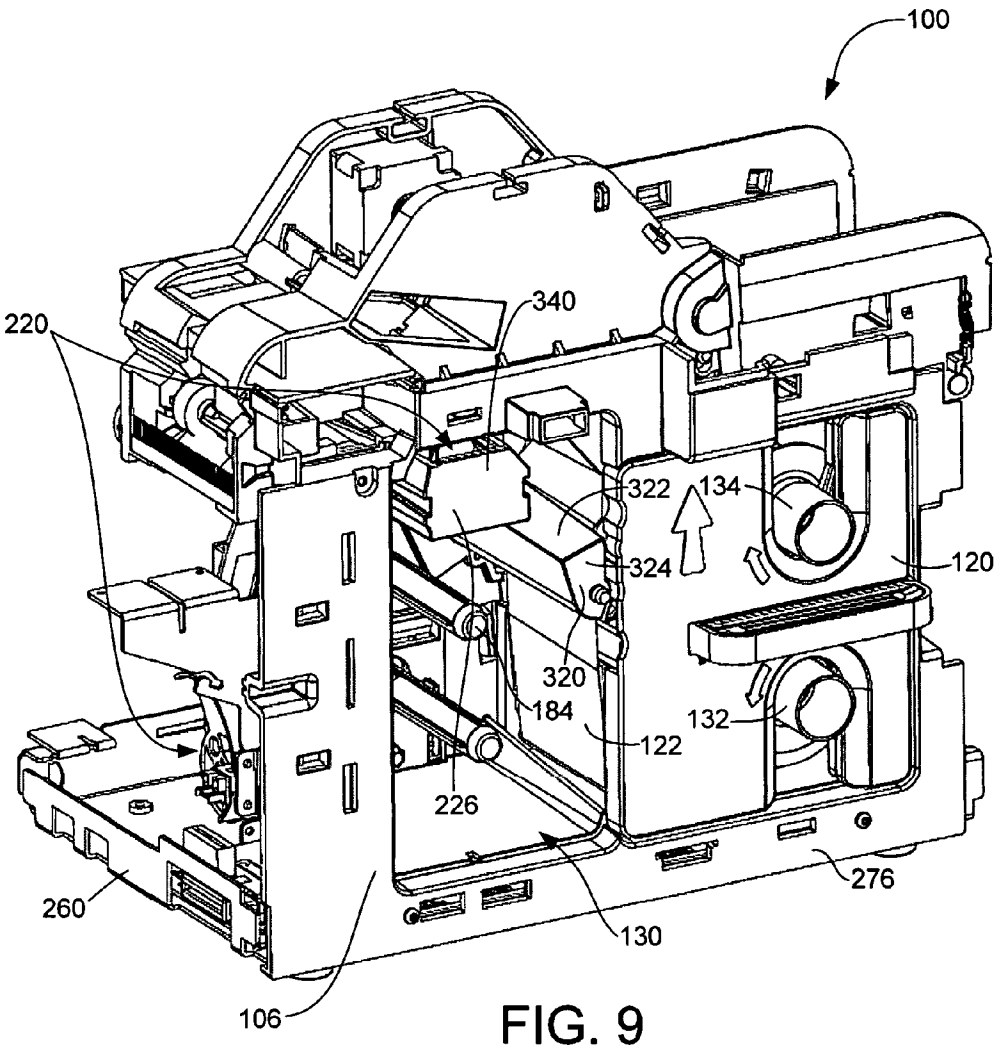
FIG. 9 is a front oblique view of the exemplary credential production device of FIG. 1 with a housing and a transfer ribbon cartridge removed and a print ribbon cartridge installed.

FIG. 9 illustrates a front perspective view of the credential production device 100 with the print ribbon cartridge 120 loaded in the print ribbon cartridge receiver 128 of the frame 106 and with the transfer ribbon cartridge 124 removed from the transfer ribbon cartridge receiver 130 of the frame 106. One embodiment of the frame 106 includes a transfer roller assembly housing 226 that is positioned towards an upper portion of the frame 106 and within the transfer ribbon cartridge receiver 130. The transfer roller assembly housing 226 is configured to house and provide support for a portion of the transfer roller assembly 220. When the transfer ribbon cartridge 124 (FIG. 2) is inserted into the transfer ribbon cartridge receiver 130 of the frame 106, the transfer roller assembly housing 226 is positioned within transfer ribbon cartridge 124. Such a position is schematically represented in FIG.7.

FIG. 10 illustrates a rear perspective view of one embodiment of the transfer roller assembly 220. In FIG. 10, the housing 101 (FIG. 1) of the credential production device 100 and the internal frame 106 are removed to better illustrate components of the transfer roller assembly 220. The transfer roller assembly 220 is also schematically illustrated in FIG. 11.

In one embodiment, the transfer roller assembly 220 includes a support member 228 that is pivotally coupled to a frame 230 of the device 100 at a pivotal axis 232. The support member 228 includes a first portion 234, which is cantilevered from the frame 230 at the pivotal axis 232. The transfer roller 222 is coupled to the first portion 234 of the support member 228 at a pivotal axis 236. While the pivotal axis 232 allows the support member 228 to rotate relative to the frame 230, the pivotal axis 236 allows the transfer roller 222 to rotate about the first portion 234 of the support member 228. In general, the pivotal axis 236 is located in the center of the transfer roller 222. However, the pivotal axis 236 can couple the transfer roller 222 to the first portion 234 in a location other than the center of the transfer roller 222.

One embodiment of the support member 228 also includes a second portion 238 that is integrally connected to the first portion 234. The second portion 238 extends at an angle to the first portion 234 and has a fixed position relative the first portion 234. The second portion 238 of the support member 228 includes a spring arm 240 that is coupled to the second portion 238 at three points. A first end 242 and a second end 244 are attached to the second portion 238. In addition, the spring arm 240 is attached to the second portion 238 by a spring 246 (FIG. 7).

In one embodiment, the assembly 220 includes an actuation mechanism 248 coupled to the frame 230. The actuation mechanism 248 is configured to engage the second portion 238 of the support member 228 to pivot the second portion 238 and the first portion 234 about the pivotal axis 232. The actuation mechanism 248 acts as a biasing mechanism for biasing the first portion 234 into an operating position. One embodiment of the assembly 220 includes a sensor 250 (FIG. 10) that is configured to sense an angular position of the first portion 234 relative to the frame 230. The actuation mechanism 248 receives signals from the sensor 250 to determine how far the first portion 234 should be moved to reach the operating position.

As illustrated in FIGS. 6 and 7, one embodiment of the actuation mechanism 248 includes a cam mechanism 252 operably coupled to a motor (not illustrated in FIGS. 6 or 7). The cam mechanism 252 is configured to apply pressure on the spring arm 240 to rotate the second portion 238 and the first portion 234 about the pivotal axis 232. The rotation of the second portion 238 and the first portion 234 by the actuation mechanism 248 causes the transfer roller 222 to move to the operating position, in which the transfer roller 222 is positioned adjacent the processing path 112 and applies a pressure to the transfer ribbon 126, the credential substrate 110 and the platen 224, as shown in FIG. 3. When in this operating position the reverse-image printed on the transfer ribbon 126 is transferred to the bottom surface 188 of the credential substrate 110 in response to the pressure applied by the transfer roller 222 and heat generated by the transfer roller 222. When the transfer roller 222 is in the operating position, the pivotal axis 236 allows the transfer roller 222 to pivot relative to the first portion 234. Such a movement is available for making fine-tune position adjustments, which can accommodate different sizes of credential substrates, for example. The actuation mechanism 248 is also configured to reversely rotate the second portion 238 and the first portion 234 to move the transfer roller 222 to a non-operating position, in which the transfer roller 222 is moved away from the processing path 112.

In one embodiment, the credential production device 100 includes a data reader/writer 254, shown schematically in FIG. 3, that is configured to read and/or write data to the substrate 110, as represented by arrow 256. Exemplary data reader/writers 254 include magnetic stripe reader/writers configured to read data from and/or write data to a magnetic stripe on the credential substrate 110, a bar code reader/writers configured to read data from a barcode on the substrate 110 and/or write data to the barcode on the substrate 110, a memory reader/writer, such as a smartcard encoder, configured to read data from a memory of the substrate 110 and/or write data to the memory of the substrate 110, and other data reader/writers. In one embodiment, the data reader/writer 254 is positioned above the processing path 112 and is configured to read and/or write data at a top surface of the substrate 110.

Figure 12:
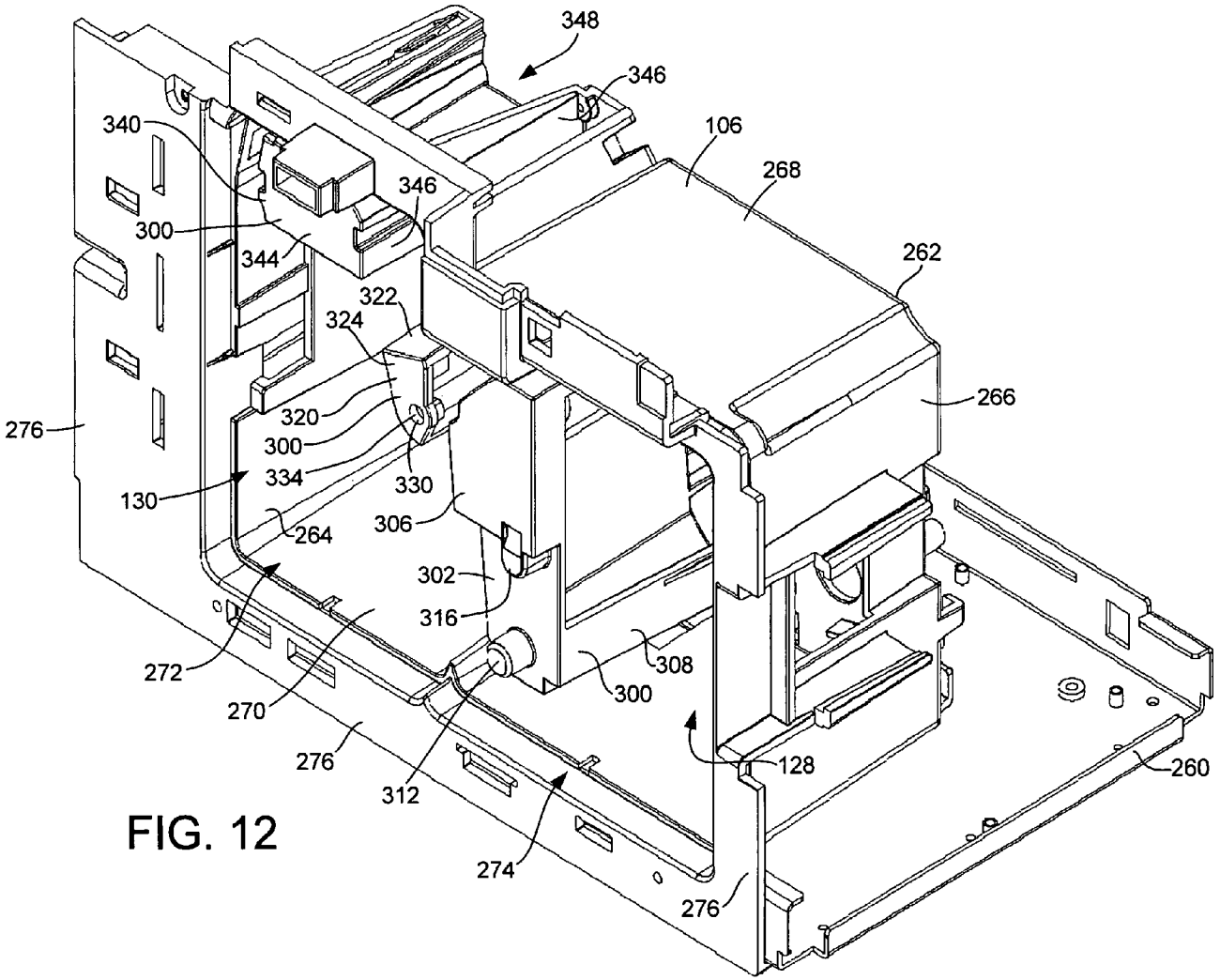
FIG. 12 is a front oblique view of a unitary frame mounted to a base in accordance with embodiment of the invention.

In one embodiment of the device 100, the unitary frame 106 is mounted to a base 260 of the credential production device 100, as shown in the front oblique view of FIGS. 9 and 12.

The unitary frame 106 provides several advantages over conventional credential production device designs utilizing non-unitary frames. Examples of these advantages include increased structural rigidity, weight reduction, reduced complexity, unique cantilevered supports, accurate registration of components relative to each other through their registration to the frame, and other advantages. Additionally, the unitary frame 106 simplifies assembly of the device 100, reduces the number of parts of the device 100 and allows the device 100 to be formed very compactly, for example. These advantages operate to reduce production costs while improving the quality of the device 100 and the credential production processes it performs.

Figure 13:
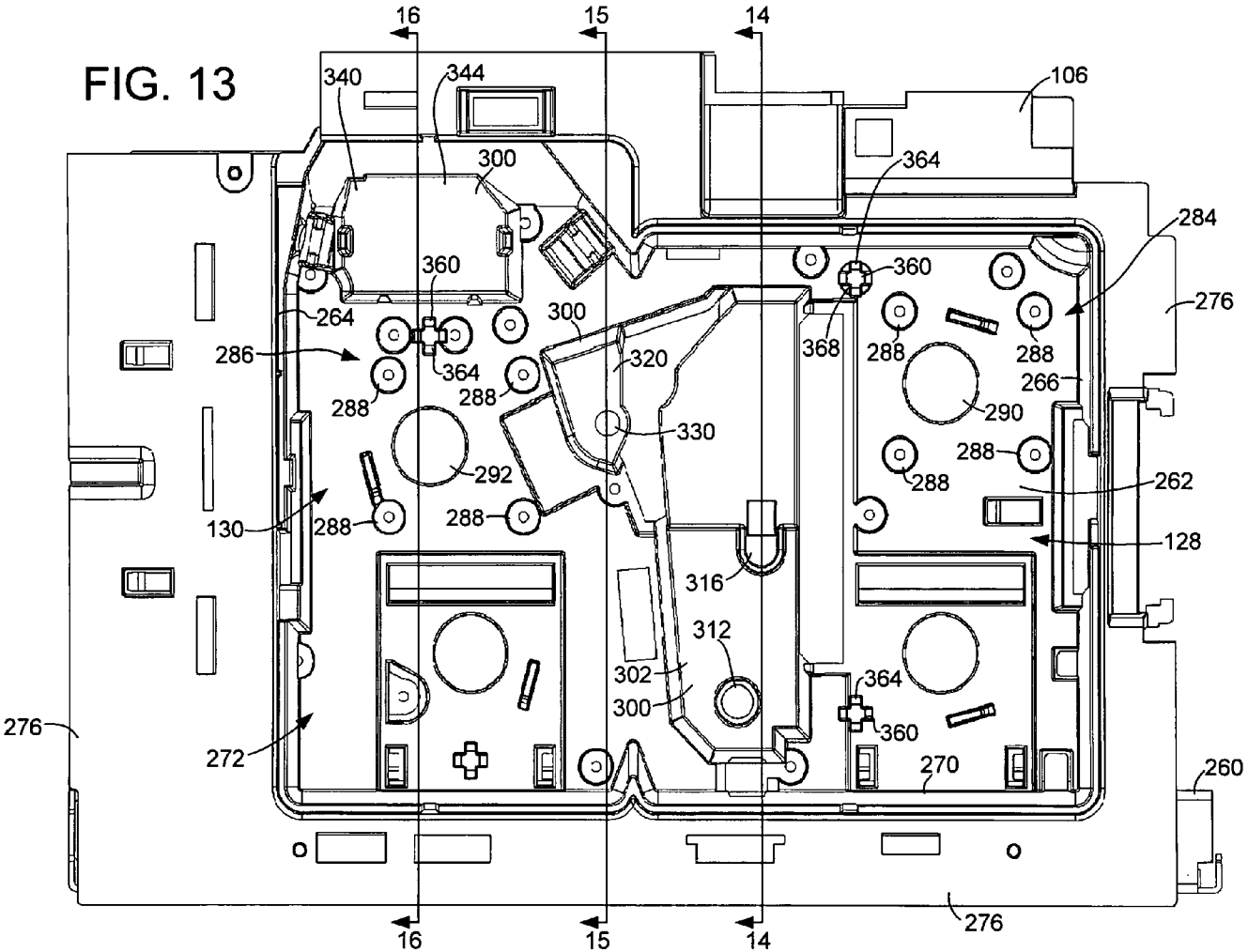
FIG. 13 is a front plan view of a unitary frame in accordance with embodiments of the invention.

FIG. 12 is a front oblique view of the unitary frame 106, in accordance with embodiments of the invention, mounted to a base 260 of the credential production device 100. Most of the components of the device 100 are removed in FIG. 12. FIG. 13 is a front plan view of the frame 106 mounted to the base 260.

The unitary frame 106 generally comprises a rear wall 262, a pair of side walls 264 and 266 extending from opposing sides of the rear wall 262, a top wall 268 extending from a top side of the rear wall and coupled to the side walls 264 and 266, a bottom wall 270 extending from a bottom side of the rear wall 262 and coupled to the side walls 264 and 266. One embodiment of the unitary frame 106 is formed of injection-molded plastic.

An interior cavity 272 having a front opening 274 is defined by the rear wall 262, the side walls 264 and 266, the top wall 268 and the bottom wall 270. The cavity 272 includes the print ribbon cartridge receiver 128 and the transfer ribbon cartridge receiver 130, which are shaped to respectively receive the print ribbon cartridge 120 and the transfer ribbon cartridge 124, as discussed above.

One embodiment of the frame 106 includes a flange 276 that extends from the side walls 264 and 266, the top wall 268 and/or the bottom wall 270. In one embodiment, the flange 276 extends around the opening 274 to the interior cavity 272, as shown in FIGS. 12 and 13. The flange 276 increases the structural rigidity of the frame 106 and provides a location for attaching the frame 106 to other components of the device 100, such as the base 260 and the housing 101.

Embodiments of the unitary frame 106 allow for direct registration of various components of the credential production device 100 to the frame 106. The registration of a component of the device 100 to the frame 106 allows its location to be known relative to the frame 106 and other components that are registered to the frame.

In one embodiment, the frame 106 provides for direct registration of one or more processing components of the credential production device 100 that are used in the processing of the credential substrate 110. Exemplary processing components include the printhead 114, the platen 116, the print ribbon cartridge 120, the transfer ribbon cartridge 124, the transfer roller 222 and other processing devices. This registration is facilitated by providing direct support for the device and/or providing one or more device registration members that interact with cooperating frame registration members of the processing component.

The device registration of the components to the frame 106 allow for both the location and/or orientation of the components to be known relative to the frame 106. The registration of multiple components to the unitary frame 106 allow for their relative positions/locations to be accurately known through the frame 106. Because the frame 106 is a single unit, the tolerances of the positions of the devices relative to each other can be maintained much more tightly than conventional designs where components are not directly registered to a unitary frame. The improved accuracy of the positioning of the components relative to the frame 106 and each other can be used to improve the quality of the processes that are performed on the credential substrates 110, such as printing, laminating, feeding, data writing and other processes.

In one embodiment, the device registration members of the frame 106 include one or more integral mounting members that cooperate with mounting members of the processing component to mount the processing component in a predetermined fixed relation to the unitary frame 106.

In one embodiment, the motor 176 and shaft 178 form a print ribbon motor and shaft assembly 280 processing component, and the motor 182 and shaft 184 form a transfer ribbon motor and shaft assembly 282 processing component, as shown in FIG. 3. One embodiment of the frame 106 includes device registration members in the form of mounting members 284 and 286 that are integrally formed in the rear wall 262 to which the assemblies 280 and 282 are respectively mounted. Each of the mounting members comprise apertures 288 that are positioned to correspond to frame registration or mounting members of the motor and shaft assemblies. The mounting members of the motor and shaft assemblies can include apertures or other suitable components that can cooperate with the mounting members of the frame 106 to secure the motor and shaft assemblies in a predetermined fixed relation to the frame 106. The shaft 178 extends through aperture 290 of the mounting member 284 and the shaft 184 extends through aperture 292. Screws or other suitable fasteners extend through the apertures 288 of the cooperating mounting members to secure the motor and shaft assemblies 280 and 282 to the frame 106. This manner of mounting the assemblies 280 and 282 to the frame 106 places the assemblies in a known position relative to the frame 106 and to other components that are mounted in a known relation to the frame 106.

One embodiment of the frame 106 includes one or more device supports 300 that are attached to the rear wall 262 and cantilevered into the interior cavity 272. Such device supports 300 engage one of the processing components of the device 100, such as the printhead 114, the print platen 116 and the transfer roller 222. It should be understood that the term "cantilevered" is intended to mean that the device support is supported only at one end of the support, such as, for example, at the rear wall 262 end of the support 300. These cantilevered supports 300 allow components of the device 100, such as the print ribbon cartridge 120 and the transfer ribbon cartridge 124, to surround the device support 300 and the corresponding processing component, if desired. When the device 100 is fully assembled, the device supports 300 may receive support at the cantilevered end from, for example, the front panel 102 (FIGS. 1-2) when it is closed. Even so, the device supports 300 are still "cantilevered" with respect to the present invention in terms of the unitary frame 106. Embodiments of the device supports 300 will be described with reference to exemplary device supports depicted in FIGS. 14-16.

Figure 14:
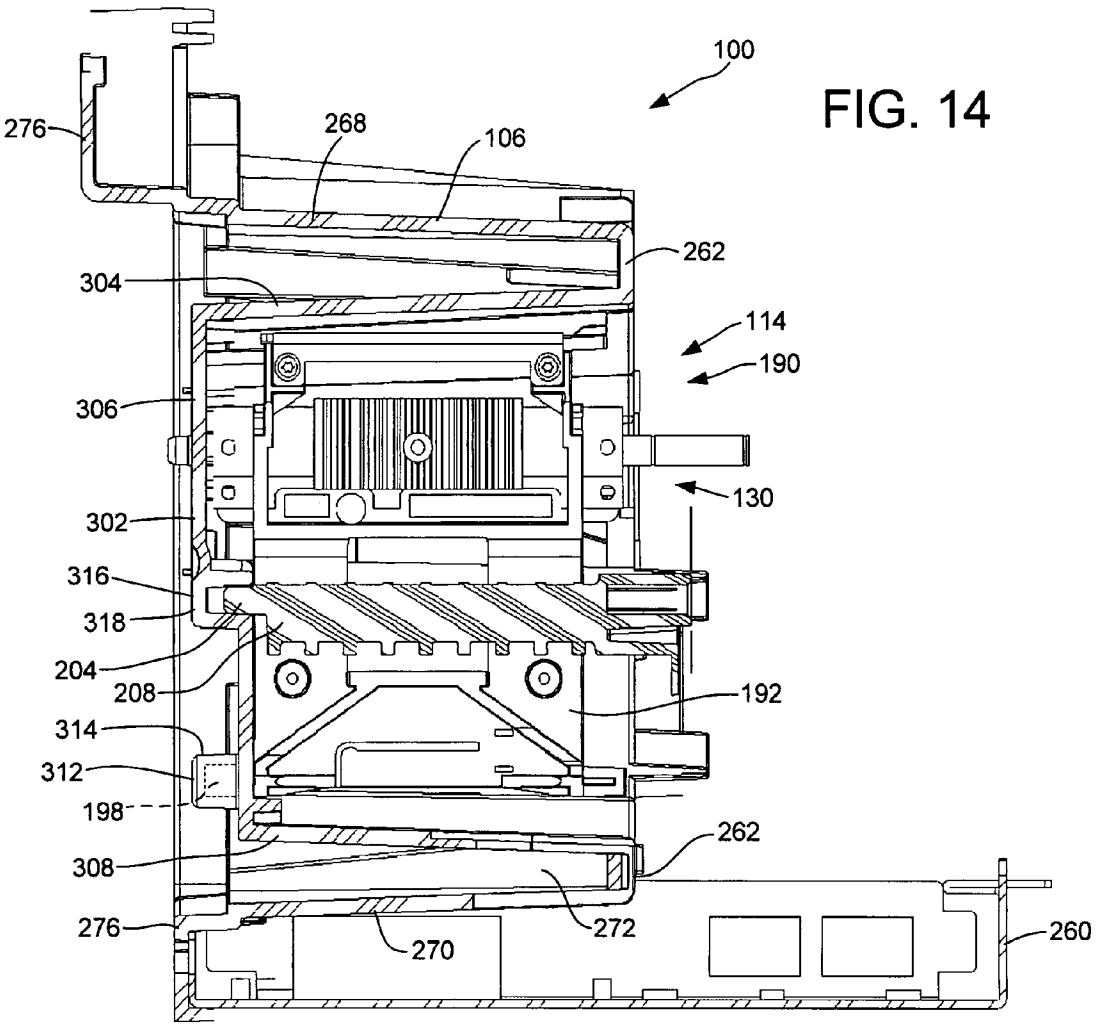
FIG. 14 is a cross-sectional view of a unitary frame in accordance with embodiments of the invention taken generally along line 14-14 of FIG. 13.

One exemplary device support 300 is a printhead device support 302 that comprises the printhead housing 200 and is located within the print ribbon cartridge receiver of the interior cavity. FIG. 14 is a cross-sectional view of taken generally along line 14-14 of FIG. 13 with the printhead 114 installed. The printhead device support 302 is attached to the rear wall 262 and is cantilevered into the interior cavity 272. In one embodiment, the printhead device support 302 extends substantially perpendicularly from the rear wall 262.

The printhead device support 262 comprises the printhead housing 200 and includes a first member 304 that extends from the rear wall 262 into the interior cavity 272. In one embodiment, the printhead device support 302 includes a front member 306 that is attached to the first member 304 and is oriented transversely to the first member 304. Embodiments of the invention include displacing the front member 306 from the rear wall 262 by more than 1 inch, by more than 2 inches, by more than 3 inches and by more than 4 inches. Another embodiment of the printhead device support 302 includes a second member 308 that is attached to the rear wall 262, extends into the interior cavity 272 and is attached to the front member 306. One embodiment of the rear wall 262 of the frame 106 includes an opening 310 between the first and second members 304 and 308. The opening 310 allows for the installation of the printhead 114 into the printhead device support 302.

One embodiment of the printhead device support 302 includes a first device registration member 312 in the front member that is configured to receive and support the pivotable coupling 198 of the printhead assembly 190. In one exemplary embodiment, the first device registration member includes a socket 314 that receives the end of the pivotable coupling 198. The first device registration member 312 can also take on other forms, such as an aperture, for example, and provide the desired registration of the printhead 114 and/or the assembly 190 relative to the frame 106.

In accordance with another embodiment, the printhead device support 302 includes a second device registration member 316 in the front member 306 that is configured to receive and provide support for the pivot point 204 of the cam element 208. As with the first device registration member 312, one embodiment of the second device registration member 316 includes a socket 318 that receives the pivot point 204. The second device registration member 316 can also take on other forms, such as an aperture or other member, for example, and provide the desired registration of the printhead 114 and/or the assembly 190 relative to the frame 106.

Figure 15:
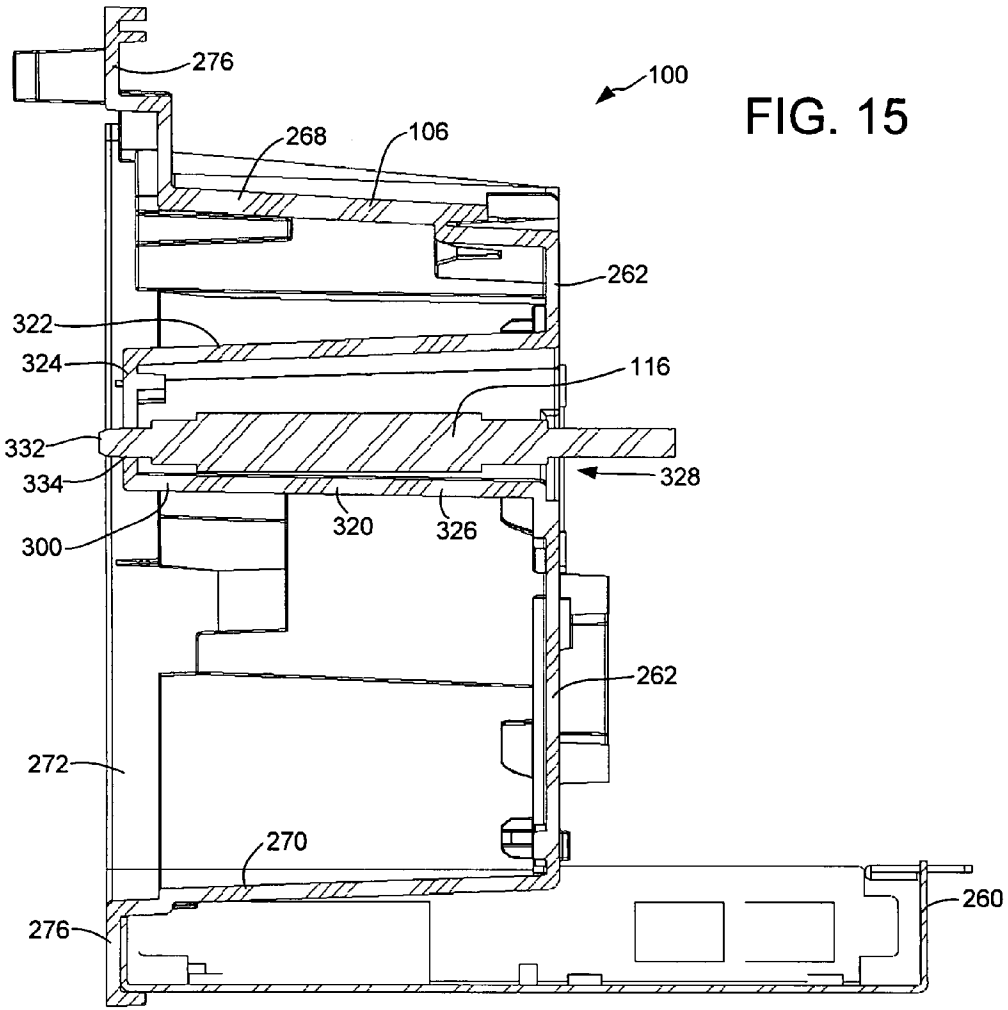
FIG. 15 is a cross-sectional view of a unitary frame in accordance with embodiments of the invention taken generally along line 15-15 of FIG. 13.

Another exemplary device support 300 is a platen device support 320, which receives the platen 116. FIG. 15 is a somewhat simplified cross-sectional view of taken generally I5 along line 15-15 of FIG. 13 with the platen 116 installed. The platen device support 320 is attached to the rear wall 262 and is cantilevered into the interior cavity 272. In one embodiment, the platen device support 320 extends substantially perpendicularly from the rear wall 262.

The platen device support 320 includes a first member 322 that extends from the rear wall 262 into the interior cavity 272. In one embodiment, the platen device support 320 includes a front member 324 that is attached to the first member 322 and is oriented transversely to the first member 322. Embodiments of the invention include displacing the front member 324 from the rear wall 262 by more than 1 inch, by more than 2 inches, by more than 3 inches and by more than 4 inches. Another embodiment of the platen device support 320 includes a second member 326 that is attached to the rear wall 262, extends into the interior cavity 272 and is attached to the front member 324. One embodiment of the rear wall 262 of the frame 106 includes an opening 328 between the first and second members 322 and 326. The opening 328 allows for the installation of the platen 116 into the platen device support 320.

One embodiment of the platen device support 320 includes a device registration member 330 in the front member 324 that is configured to receive and support the end 332 of the platen 116. The engagement of the registration member 330 to the end 332 of the platen 116 positions the end 332 of the platen 116 in a known location relative to the frame 106. As a result, the platen 116 can be accurately positioned relative to other components that are directly registered to the frame 106, such as the printhead 114. In one exemplary embodiment, the device registration member 330 includes an aperture 334 that receives the end 332 of the platen 116. The device registration member 330 can also take on other forms and still provide the desired registration of the platen 116 relative to the frame 106.

Figure 16:
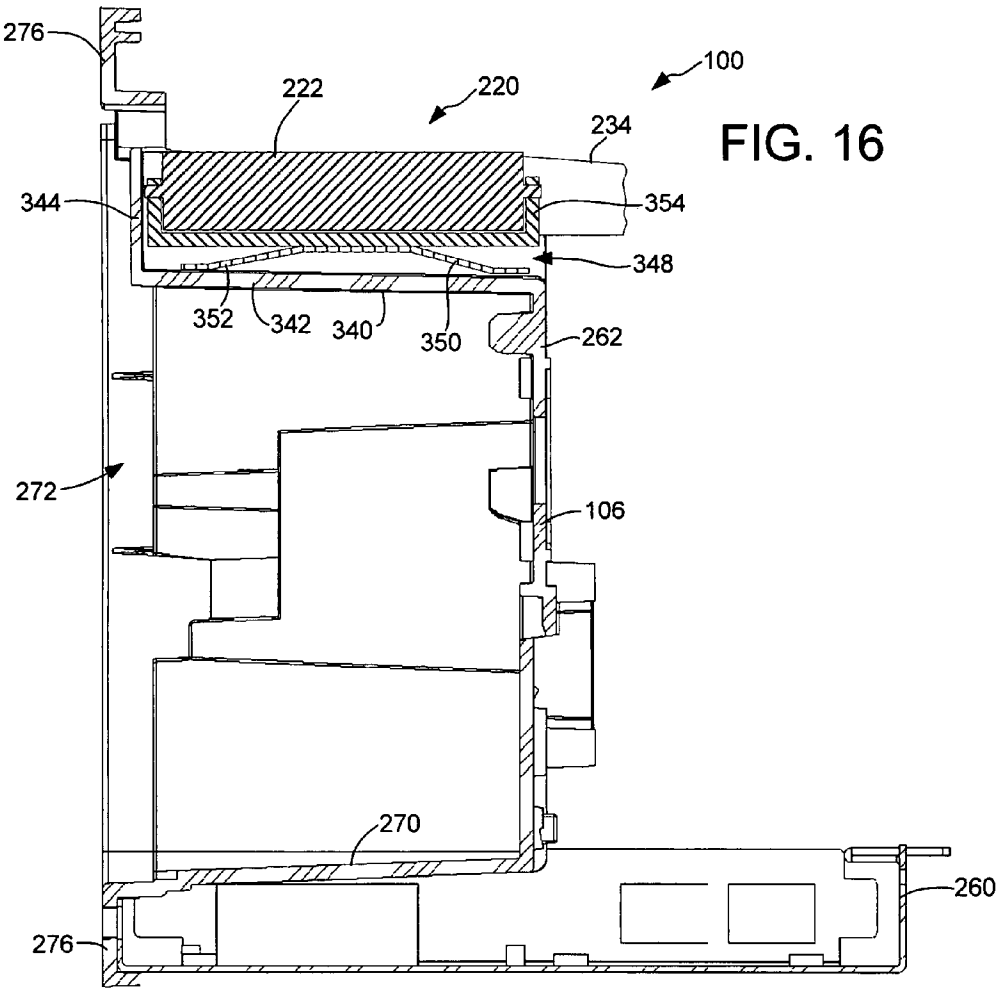
FIG. 16 is a cross-sectional view of a unitary frame in accordance with embodiments of the invention taken generally along line 16-16 of FIG. 13.

Another exemplary device support 300 is a transfer roller device support 340 that comprises the transfer roller housing 226 and is located within the transfer ribbon cartridge receiver 130 of the interior cavity 272 of the frame 106. FIG. 16 is a somewhat simplified cross-sectional view of taken generally along line 16-16 of FIG. 13 with the transfer roller 222 installed. The transfer roller device support 340 is attached to the rear wall 262 and is cantilevered into the interior cavity 272. In one embodiment, the transfer roller device support 340 extends substantially perpendicularly from the rear wall 262.

The transfer roller device support 340 includes a first member 342 that extends from the rear wall 262 into the interior cavity 272. In one embodiment, the transfer roller device support 340 includes a front member 344 that is attached to the first member 342 and is oriented transversely to the first member 342. Embodiments of the invention include displacing the front member 344 from the rear wall 262 by more than 1 inch, by more than 2 inches, by more than 3 inches and by more than 4 inches. Another embodiment of the transfer roller device support 340 includes a second member 346 (FIG. 12) that is attached to the rear wall 262, extends into the interior cavity 272 and is attached to the front member 344. One embodiment of the rear wall 262 of the frame 106 includes an opening 348 that allows for the installation of the transfer roller 222 into the transfer roller device support 340.

One embodiment of the transfer roller assembly 220 includes a pair of spring arms 350 and 352 attached to the support 354. In one embodiment of the transfer roller device support 340 the first member 342 operates as device registration member that provides support to the spring arms 350 and 352. During an image transfer operation, the transfer roller 222 is in the operating position adjacent the processing path 112 (FIG. 3). As the substrate 110 is fed over the transfer roller 222, the transfer roller 222 will deflect slightly downward and away from the processing path 112. This deflection is absorbed in the spring arms 350 and 352 which are supported by the member 342 of the transfer roller device support 340. When the substrate 110 is fed beyond the transfer roller 222, the spring arms 350 and 352 press the transfer roller 222 back to the non-deflected operating position adjacent the processing path 112. The allowance for this deflection accommodates the thickness of the substrate 110 while maintaining the desired pressure against the substrate 110 that is necessary for high quality image transfer. Additionally, the ability of the transfer roller 222 to pivot about axis 236 (FIGS. 10 and 11) ensures that the pressure applied to the substrate 110 by the transfer roller is evenly distributed across the width of the substrate 110.

Additional embodiments of the unitary frame 106 include one or more device registration members 360 that are configured to cooperate (i.e., engage) with frame registration members 362 of the print and transfer ribbon cartridges 120 and 124. As above, the device and frame registration members engage each other when the print and transfer ribbon cartridges 120 and 124 are received in the print and transfer ribbon cartridge receivers 128 and 130 of the frame 106 to place the cartridges 120 and 124 in a known position relative to the frame 106 and each other through the frame 106. This registration of the print and transfer ribbon cartridges 120 and 124 results in tighter tolerances and more accurate transfer printing operations.

The one or more device registration members 360 can be formed in the rear wall 262, the side walls 264 and 266, the top wall 268 and/or the bottom wall 270 within or adjacent to the print and transfer ribbon cartridge receivers 128 and 130. The one or more frame registration members 262 of the cartridges 120 and 124 are formed on their housings (such as rear wall 154 and rear wall 164) such that they engage the corresponding device registration members 360 of the frame 106 to place the cartridges 120 and 124 in a known position and possibly a known orientation relative to the frame 106 and each other. In one embodiment, each cartridge 120 and 124 includes two frame registration members 362 and the frame 106 includes four device registration members 360, two for each of the cartridges 120 and 124.

One exemplary embodiment of the device registration members 360 of the frame 106 comprise one or more sockets 364 formed in the rear wall 262 within the print and transfer ribbon cartridge receivers 128 and 130, as shown in FIG. 13. The sockets 364 can be in any desired shape. The sockets 364 may also be in the form of apertures or bores in the rear wall 262.

One exemplary embodiment of the frame registration members 362 of the cartridges 120 and 124 includes protuberances or protrusions 366 respectively extending from the rear walls 154 and 164. The protrusions 366 are positioned to be received within the sockets 364 of the frame 106 when the print and transfer ribbon cartridges 120 and 124 are received within the print and transfer ribbon cartridge receivers 128 and 130, respectively.

It is understood that the device registration members 360 could comprise the protrusions 366 and the frame registration members 362 could comprise the sockets 364. Accordingly, embodiments include replacing one or more of the sockets 364 of the frame 106 with protrusions 366 and replacing the corresponding protrusions 366 of the cartridges 120 and 124 with sockets 364.

In one embodiment, the sockets 364 have non-circular shaped interior cavity 368. One embodiment of the protrusions 366 have non-circular cross-sections that include features that conform to the portion of the interior cavity 368 of the non-circular sockets 364. In one embodiment, the shapes of the interior cavity 368 of the sockets 364 and the exterior surface of the protrusions 366 are selected such that the protrusions 366 must be placed in a proper orientation relative to the sockets 364 in order to be received within the sockets 364. As a result, the cartridges 120 and 124 are positioned in a known location and orientation relative to the frame 106 and each other.

In one exemplary embodiment of this configuration, the sockets 364 are cross-hair sockets having a cross-shaped interior cavity 368 and the protrusions 366 have a cross-shaped cross-section, as shown in FIGS. 6, 7 and 13. When the cartridges 120 and 124 are received within the corresponding print and transfer ribbon cartridge receivers 128 and 130, this embodiment restricts the cartridges 120 and 124 to a predetermined location and orientation relative to the frame 106 and each other through the frame 106.

Credential production devices 100 formed in accordance with the present invention, include one or more of the embodiments of the unitary frame 106 described above. Exemplary advantages of such a device 100 include more precise relative positioning of the processing components of the device 100 through direct registration of the components relative to the frame 106 resulting in higher quality credential substrate processing and production, a reduction in the size and weight of the device 100 as a result of the elimination of the sheet metal frames of conventional credential production devices and the use of the injection-molded unitary frame 106, the simplification of assembly of the device 100 by the elimination of parts and the formation of mounting members in the frame 106 to which components can be directly attached, and other advantages understood by those skilled in the art of credential production devices.

Although the present invention has been described with reference to preferred embodiments, workers skilled in the art will recognize that changes may be made in form and detail without departing from the spirit and scope of the invention.

What is claimed is:

1. A credential manufacturing device comprising:

an injection-molded unitary frame formed of plastic comprising:

a rear wall;

a pair of side walls extending from opposing sides of the rear wall;

a top wall extending from a top side of the rear wall and coupled to the side walls;

a bottom wall extending from a bottom side of the rear wall and coupled to the side walls, wherein the rear wall, the side walls, the top wall and the bottom wall define an interior cavity and an opening to the interior cavity;

a first device registration member; and a second device registration member;

a first processing component comprising a first frame registration member configured to cooperate with the first device registration member to place the first processing component in a known position relative to the unitary frame and the second device registration member; and a second processing component comprising a second frame registration member configured to cooperate with the second device registration member to place the second processing component in a known position relative to the unitary frame and the first processing component.

2. The device of claim 1, wherein the first and second processing components are selected from the group consisting of a printhead, a print platen, a transfer roller, a print ribbon cartridge and a transfer ribbon cartridge.

3. The device of claim 2, wherein the first and second device registration members are selected from the group consisting of a socket and a protrusion.

4. The device of claim 3, wherein the first and second frame registration members are selected from the group consisting of a protrusion and a socket.

5. The device of claim 3, wherein the first and second device registration members are formed in the rear wall of the unitary frame.

6. The device of claim 1, wherein the first and second frame registration members comprise sockets having a cross-shaped interior cavity.

7. The device of claim 1, wherein:

the interior cavity of the frame includes a print ribbon cartridge receiver and a transfer ribbon cartridge receiver;

the first processing device comprises a print ribbon cartridge comprising a supply of print ribbon and a housing including the first frame registration member that is configured to cooperate with the first device registration member of the unitary frame to place the print ribbon cartridge in a known position relative to the unitary frame and the second device registration member when the print ribbon cartridge is received within the print ribbon cartridge receiver of the frame; and a transfer ribbon cartridge comprising a supply of transfer ribbon and a housing having the second frame registration member that is configured to cooperate with the second device registration member to place the transfer ribbon cartridge in a known position relative to the unitary frame and the print ribbon cartridge when the transfer ribbon cartridge is received within the transfer ribbon cartridge receiver of the frame.

8. The device of claim 1, wherein the unitary frame further comprises a first device support attached to the rear wall and cantilevered into the interior cavity, the first device support comprising a front member displaced more than 1 inch from the rear wall and having the first device registration member.

9. The device of claim 8, wherein the first device support extends substantially perpendicularly from the rear wall.

10. The device of claim 8, wherein the first device support comprises a first member extending from the rear wall to the front member, wherein the front member is transverse to the first member.

11. The device of claim 10, wherein the first device registration member is selected from the group consisting of a socket and an aperture.

12. The device of claim 10, wherein:

the first device support further comprises a second member extending from the rear wall to the front member; and the rear wall includes an opening between the first and second members.

13. The device of claim 8, wherein the first processing component comprises a printhead.

14. The unitary frame of claim 8, further comprising a second device support attached to the rear wall and cantilevered into the interior cavity, the second device support comprising a front end displaced more than 1 inch from the rear wall and having the second registration member.

15. The unitary frame of claim 14, further comprising a processing component selected from the group consisting of a print platen and a transfer roller supported by the second device support.

16. The unitary frame of claim 1, wherein the side walls, the top wall and the bottom wall each includes a shoulder portion extending away from the interior cavity from a front edge, which is opposite the edge that is connected to the rear wall.

17. A credential manufacturing device comprising:

an injection-molded unitary frame formed of plastic comprising:

a rear wall;

a pair of side walls extending from opposing sides of the rear wall;

a top wall extending from a top side of the rear wall and coupled to the side walls;

a bottom wall extending from a bottom side of the rear wall and coupled to the side walls, wherein the rear wall, the side walls, the top wall and the bottom wall define an interior cavity and an opening to the interior cavity;

a first device registration member; and a second device registration member;

a print ribbon cartridge comprising a supply of print ribbon and a housing having a first frame registration member that is configured to cooperate with the first device registration member to place the print ribbon cartridge in a known position relative to the unitary frame and the second device registration member when the print ribbon cartridge is received within a print ribbon cartridge receiver of the interior cavity; and a transfer ribbon cartridge comprising a supply of transfer ribbon and a housing having a second frame registration member that is configured to cooperate with the second device registration member to place the transfer ribbon cartridge in a known position relative to the unitary frame and the print ribbon cartridge when the transfer ribbon cartridge is received within a transfer ribbon cartridge receiver of the interior cavity.

18. The device of claim 17, wherein:

the first and second device registration members are selected from the group consisting of a socket and a protrusion; and the first and second frame registration members are selected from the group consisting of a protrusion and a socket.

19. The device of claim 18, wherein the first and second device registration members are formed in the rear wall of the unitary frame.

20. The device of claim 19, wherein:

the first frame registration member is formed in a rear wall of the housing of the print ribbon cartridge; and the second frame registration member is formed in a rear wall of the housing of the transfer ribbon cartridge.

* * * * *